US008916758B2

(12) United States Patent
Olsen

(10) Patent No.: US 8,916,758 B2
(45) Date of Patent: Dec. 23, 2014

(54) ADJUSTABLE MUSICAL INSTRUMENT LEVER

(71) Applicant: Michael Olsen, Elkhorn, WI (US)

(72) Inventor: Michael Olsen, Elkhorn, WI (US)

( * ) Notice: Subject to any disclaimer, the term of this patent is extended or adjusted under 35 U.S.C. 154(b) by 0 days.

(21) Appl. No.: 14/171,518

(22) Filed: Feb. 3, 2014

(65) Prior Publication Data

US 2014/0216231 A1 Aug. 7, 2014

Related U.S. Application Data

(60) Provisional application No. 61/760,594, filed on Feb. 4, 2013.

(51) Int. Cl.
*G10D 9/00* (2006.01)
*G10D 7/10* (2006.01)

(52) U.S. Cl.
CPC ... *G10B 9/04* (2013.01); *G10D 7/10* (2013.01)
USPC ..... 84/387 R

(58) Field of Classification Search
USPC ..... 84/387 A, 387 R, 380 R
See application file for complete search history.

(56) References Cited

U.S. PATENT DOCUMENTS 6,225,541 B1 * 5/2001 Kodera et al. ..... 84/385 P

* cited by examiner

*Primary Examiner* — Kimberly Lockett
(74) *Attorney, Agent, or Firm* — Absolute Technology Law Group, LLC

(57) ABSTRACT

The present invention is an adjustable musical instrument lever that changes the throw, amount of leverage, and amount of resistance the lever incurs when moved. The device also adjusts to accommodate the size of the player's hand. Further, it can be retrofit to many valved musical instruments.

12 Claims, 5 Drawing Sheets

ADJUSTABLE MUSICAL INSTRUMENT LEVER

CROSS-REFERENCE TO RELATED APPLICATIONS

This application claims priority to provisional U.S. Application No. 61/760,594, filed Feb. 4, 2013.

FIELD OF INVENTION

The present invention relates to the field of musical instruments and more particularly to an adjustable musical instrument lever.

BACKGROUND

Figure 1:
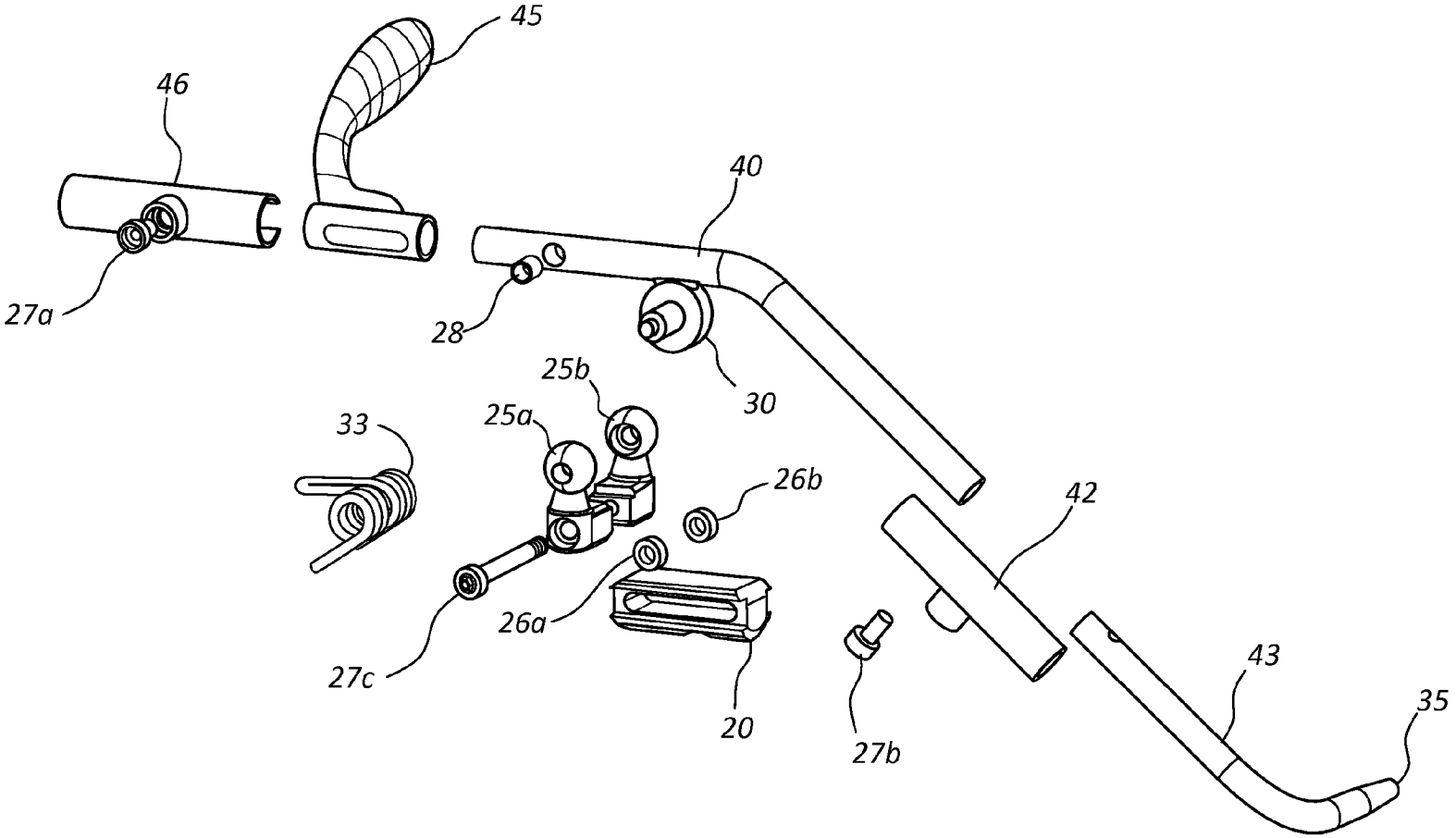
FIG. 1 illustrates an exploded view of an exemplary embodiment of an adjustable musical instrument lever.

Using the example of a trombone, slide trombone players vary the length of the trombone tube and the resulting sound pitch by selectively telescoping the slide relative to the bell portion of the trombone. The pitch is lowered as the slide is moved further away from the bell portion of the trombone. Some trombones, such as bass trombones, have extra tubing known as an F Attachment added to the bell section of the trombone. An F attachment changes the instrument from the key of B flat to the key of F. Trombones with an F attachment also have a valve, which is used to redirect the flow from the straight part of the trombone through the F attachment and back into the bell. The opening and closing of the valve is controlled by a thumb operated lever or thumb trigger. Thumb levers enable players to play effectively and seamlessly across the entire bass/tenor range.

Thumb levers known in the art are generally coupled to a biased fulcrum. The fulcrum enables the lever to be displaced in a first direction and subsequently return to its original position. The effort required to depress the thumb lever is commensurate with the length of the supplementary tubing that is engaged.

One example of thumb lever is disclosed in U.S. Pat. No. 5,396,825. A handle is attached to the end of the lever arm opposite the valve. The valve is rotatable by manual shifting of the lever arm between a first or straight through airflow position and a second or diverted airflow position. The lever arm presses against a (Kirts '825). The thumb lever taught by Kirts '825 has a lever arm connected at one spring, which returns the lever to the original position. The handle is located in a position accessible to the musician, allowing the musician to perform the push-pull movement without having to let go of the instrument. However, like other thumb levers known in the art, the position of the handle disclosed by Kirts '825 is not adjustable, and therefore is not in a desirable location for all musicians.

It is desirable to have a musical instrument thumb lever that allows the musician to adjust the location of the handle based on his or her hand size and comfort.

Glossary

As used herein, the term "throw" refers to the distance a musical instrument lever has to move to activate a valve, i.e., the distance between the first and second lever positions of a musical instrument lever.

Summary of the Invention

The present invention is an adjustable musical instrument lever. The musical instrument lever can be adjusted by moving the fulcrum point horizontally so that the handle fulcrum with bearing post is positioned closer or further from the valve. Adjusting the location of the fulcrum point changes the throw, the amount of leverage, and the amount of resistance the lever incurs when moved between a first position and a second position.

Detailed Description of Invention

For the purpose of promoting an understanding of the present invention, references are made in the text to exemplary embodiments of an adjustable musical instrument lever, only some of which are described herein. It should be understood that no limitations on the scope of the invention are intended by describing these exemplary embodiments. One of ordinary skill in the art will readily appreciate that alternate but functionally equivalent materials, components, dimensions, and placement may be used. The inclusion of additional elements may be deemed readily apparent and obvious to one of ordinary skill in the art. Specific elements disclosed herein are not to be interpreted as limiting, but rather as a basis for the claims and as a representative basis for teaching one of ordinary skill in the art to employ the present invention.

It should be understood that the drawings are not necessarily to scale; instead, emphasis has been placed upon illustrating the principles of the invention. In addition, in the embodiments depicted herein, like reference numerals in the various drawings refer to identical or near identical structural elements.

Moreover, the terms "substantially" or "approximately" as used herein may be applied to modify any quantitative representation that could permissibly vary without resulting in a change in the basic function to which it is related.

FIG. 1 illustrates an exploded view of an exemplary embodiment of adjustable musical instrument lever 100 with fulcrum with bearing post 30. In the embodiment shown, adjustable musical instrument lever 100 is comprised of a lever substrate 40, heli coil 28, spatula or handle cover 46, spatula or handle 45, dovetail slide bracket base 20, side posts 25*a* and 25*b*, with bearings 26*a* and 26*b*, spring 33, fulcrum with bearing posts 30, front telescoping lever cover 42, threaded front telescoping lever substrate 43, socket head cap screws 27*a*, 27*b*, and 27*c*, and pivot mechanism 35. Pivot mechanism 35 secures adjustable musical instrument lever 100 to stop arm 52, which attaches to the valve shaft, which protrudes through back plate 55 of rotary valve 50.

Figure 2B:
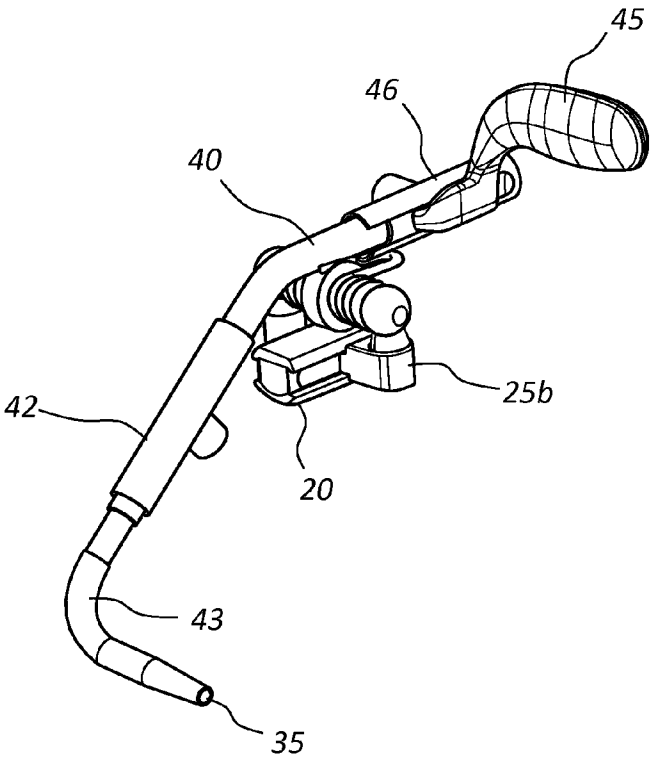
FIGS. 2*a* and 2*b* illustrate a left perspective view and a right perspective view, respectively, of an exemplary embodiment of an adjustable musical instrument lever in a first position.
Figure 2A:
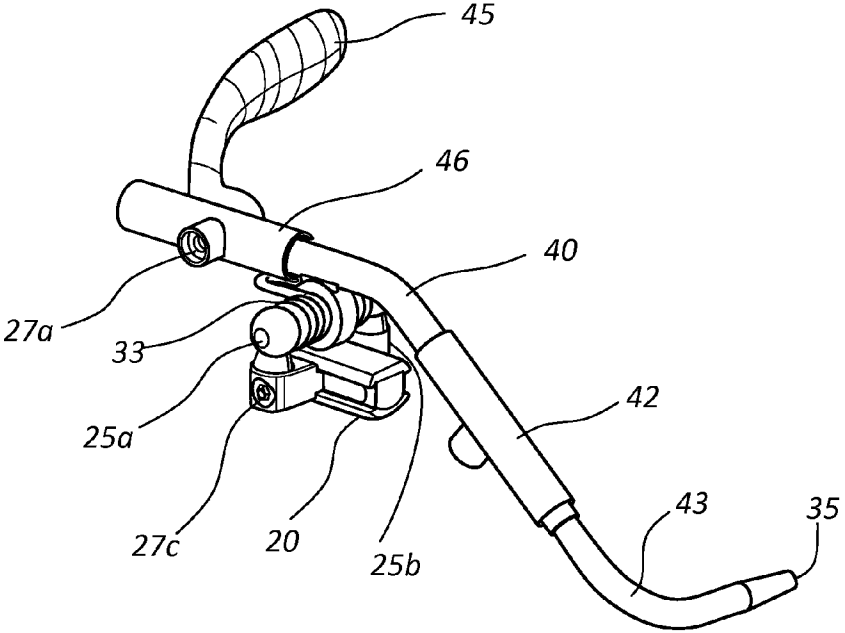

FIGS. 2*a* and 2*b* illustrate a left perspective view and a right perspective view, respectively, of an exemplary embodiment of an adjustable musical instrument lever in a first position. When spatula or handle 45 is moved from a first position to a second position, pivot mechanism 35 rotates stop arm 52, which rotates the valve shaft. Stop arm 52 is attached to the valve shaft, which is attached to the inner rotor component (not visible) of rotary valve 50, which has a plurality of passageways through which airflow may be directed. The stop arm 52 rotates the valve shaft, which causes the inner rotor component of rotary valve 50 to rotate changing the passageway through which the air flows.

In the embodiment shown, dovetail slide bracket base 20 is mounted to brace tube 15, and dovetail slide bracket base 20 is affixed to side posts 25*a* and 25*b*, which encase bearings 26*a* and 26*b*, with spring 33, by means of socket head cap screw 27*c*, and fulcrum with bearing post 30 is mounted to lever substrate 40. In the embodiment shown, fulcrum with bearing post 30 is comprised of a bearing post and a spring 33. Lever substrate 40 presses against the spring 33 of fulcrum with bearing post 30 and the spring 33 returns lever substrate 40 to the original position.

In the embodiment shown, fulcrum with bearing post 30 is positioned at the end of dovetail slide bracket base 20 furthest from rotary valve 50. The throw of lever substrate 40 can be adjusted by moving side posts 25*a* and 25*b*, which encase bearings 26*a* and 26*b*, within dovetail slide bracket base 20 by moving fulcrum forward or backward along dovetail slide bracket base 20 and securing this into position with socket head cap screw 27*c*. In this second position, fulcrum with bearing posts 30 is positioned near the end of dovetail slide bracket base 20 closest to rotary valve 50. The throw increases as fulcrum with bearing post 30 is moved toward rotary valve 50.

In an exemplary embodiment, lever substrate 40 is telescoping by means of the front telescoping lever cover 42 attached to the threaded front telescoping lever substrate 43 and secured into the desired position by socket head cap screw 27*b*, allowing the length of lever 40 to be adjusted to fit the specific musician's desired throw. Further adjustment for the fit of the musician's hand can be accomplished by adjusting the spatula or handle 45. Spatula or handle 45 may be adjusted by movement forward or backward, along with a small amount of radial positioning available, sliding over lever substrate 40 within spatula or handle cover 46 and securing the desired position with socket head cap screw 27*a* into heli coil 28.

Figure 3A:
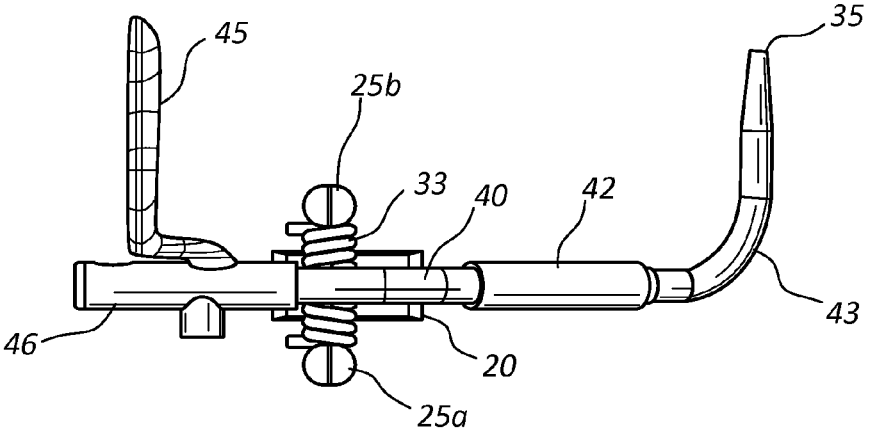
FIG. 3*a* illustrates a top view of an exemplary embodiment of an adjustable musical instrument lever in a first position.

FIG. 3*a* illustrates a top view of an exemplary embodiment of adjustable musical instrument lever 100 with fulcrum with bearing post 30 in a first position showing the adjustability of lever substrate 40 from first position to second position and the throw. In the embodiment shown, fulcrum with bearing post 30 is positioned near the end of dovetail slide bracket base 20 further from rotary valve 50.

Figure 3B:
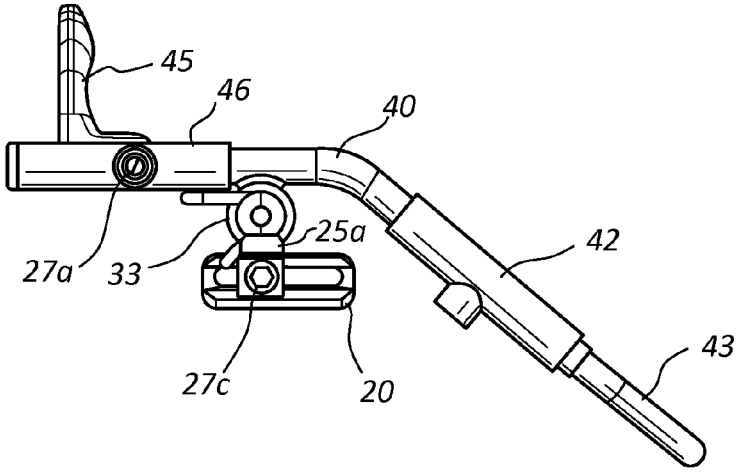
FIG. 3*b* illustrates a left side view of an exemplary embodiment of an adjustable musical instrument lever in a first position.

FIG. 3*b* illustrates a left side view of an exemplary embodiment of an adjustable musical instrument lever 100 with fulcrum with bearing post 30 in a first position showing the adjustability of lever substrate 40 from first position to second position and the throw. In the embodiment shown, fulcrum with bearing post 30 is positioned near the end of dovetail slide bracket base 20 further from rotary valve 50.

Figure 4:
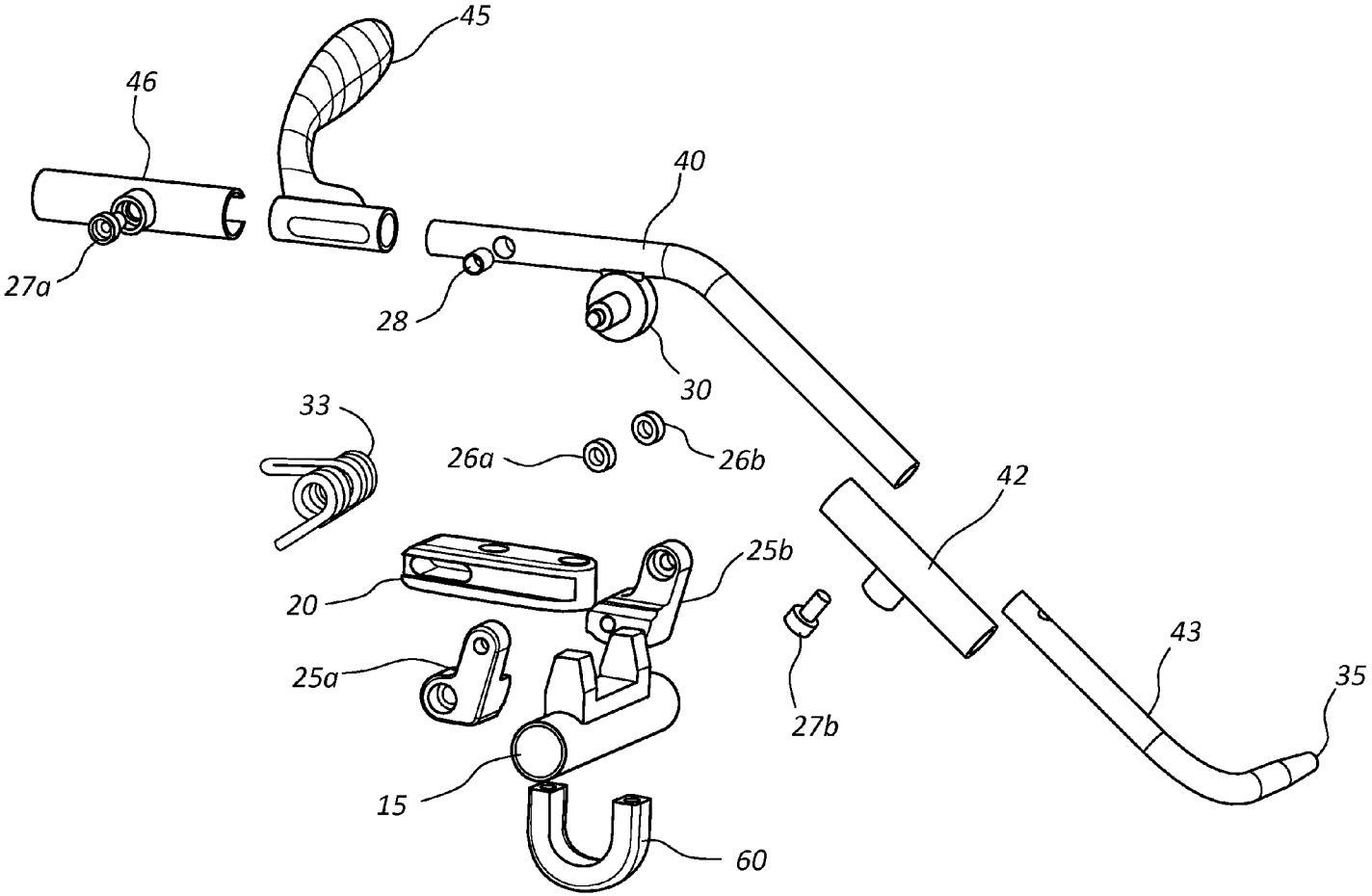
FIG. 4 illustrates an exploded view of a second exemplary embodiment of an adjustable musical instrument lever.

FIG. 4 illustrates an exploded view of a second exemplary embodiment of retrofit adjustable musical instrument lever 200. In the embodiment shown, retrofit adjustable musical instrument lever 200 is comprised of lever substrate 40, pivot mechanism 35, spatula or handle 45, spatula or handle cover 46, front telescoping lever cover 42, threaded front telescoping lever substrate 43, side posts 25*a* and 25*b*, bearings 26*a* and 26*b*, spring 33, dovetail clamp 60, dovetail slide bracket base 20, socket head cap screws 27*a*, 27*b*, and 27*c*, and fulcrum with bearing post 30. Pivot mechanism 35 secures retrofit adjustable musical instrument lever 200 to stop arm 52, which secures to valve shaft that protrudes through back plate 55 of rotary valve 50. In the embodiment shown, fulcrum with bearing post 30 is comprised of a bearing post and a spring 33.

Figure 5B:
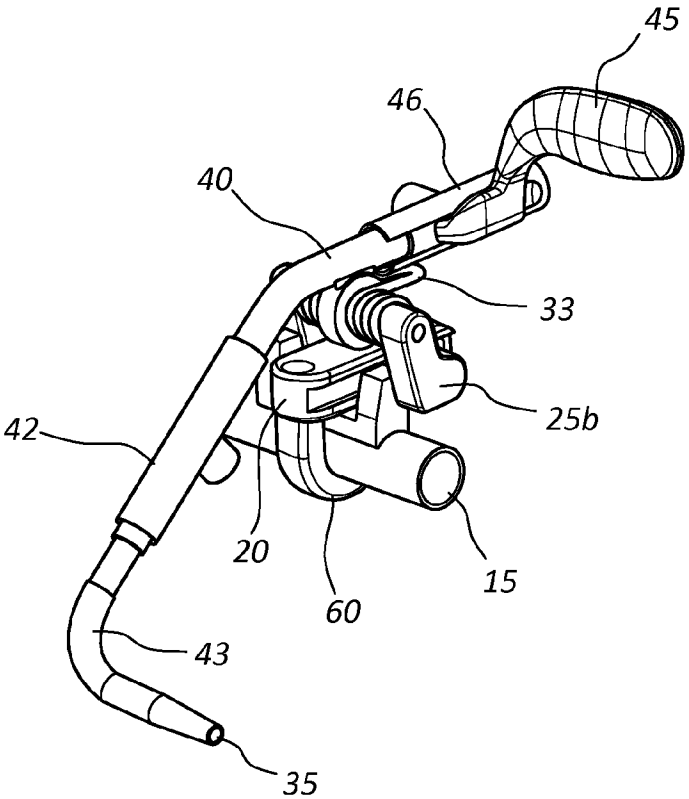
FIGS. 5*a* and 5*b* illustrate a left perspective view and a right perspective view, respectively, of a second exemplary embodiment of an adjustable musical instrument lever in a first position.
Figure 5A:
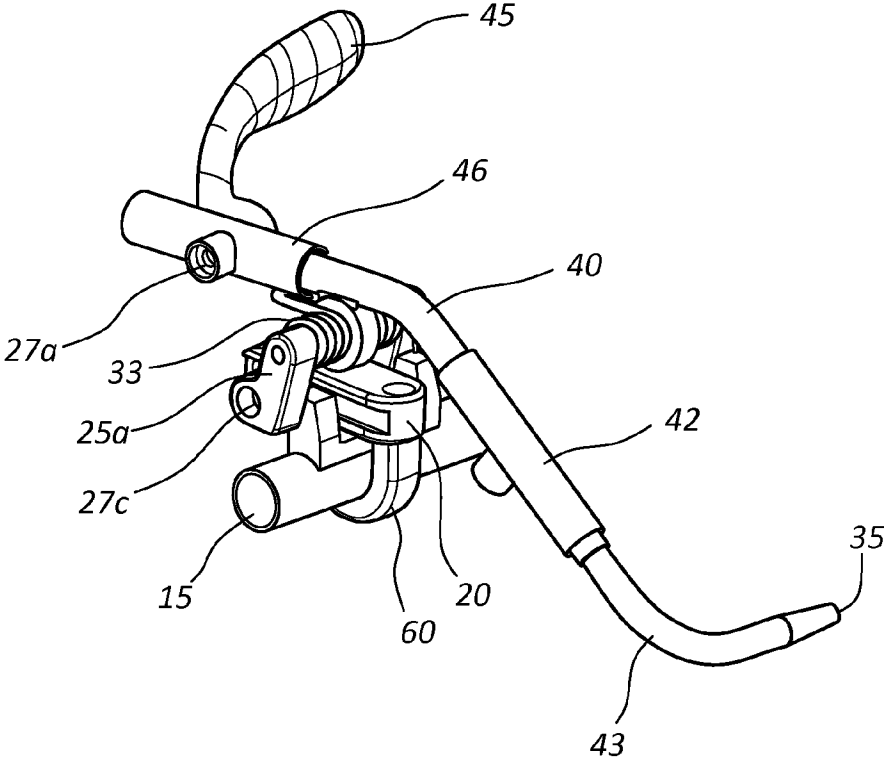

FIGS. 5*a* and 5*b* illustrate a left perspective view and a right perspective view, respectively, of a second exemplary embodiment of an adjustable musical instrument lever 200 in a first position. Dovetail clamp 60 is secured around existing lever bracket and brace tube with an existing saddle bracket 15. This dovetail clamp 60 allows the adjustable musical instrument lever 200 to be retrofit to many valved musical instruments.

In the embodiment shown, fulcrum with bearing post 30 is positioned at the end of dovetail slide bracket base 20 furthest from rotary valve 50. The throw of lever substrate 40 can be adjusted by moving side posts 25*a* and 25*b*, which encase bearings 26*a* and 26*b*, within dovetail slide bracket base 20 by moving fulcrum forward or backward along dovetail slide bracket base 20 and securing this into position with socket head cap screw 27*c*. In this second position, fulcrum with bearing posts 30 is positioned near the end of dovetail slide bracket base 20 closest to rotary valve 50. The throw increases as fulcrum with bearing post 30 is moved toward rotary valve 50.

What is claimed is:

1. A musical instrument lever comprising:

a lever substrate;

a handle;

a fulcrum, wherein said fulcrum has a bearing post and is adjustably connected to a brace tube of a musical instrument; and a pivot mechanism, wherein said lever substrate is operatively connected to said handle at a first end, operatively connected to said fulcrum between said first end and a second end and operatively connected to said pivot mechanism at said second end, wherein said second end of said lever substrate includes a front telescoping lever cover operatively connected to a threaded front telescoping lever substrate, wherein at least one connector operatively connects said threaded front telescoping lever substrate to said pivot mechanism, wherein said pivot mechanism is operatively connected to a valve of said musical instrument.

2. The musical instrument lever of claim 1, wherein said fulcrum further includes at least one side post, wherein said at least one side post has at least one bearing.

3. The musical instrument lever of claim 2, wherein said at least one bearing is slidably connected to a slide bracket base.

4. The musical instrument lever of claim 3, wherein said slide bracket base is operatively connected to said brace tube and said slide bracket base has a dovetail configuration which is slidably connected to said at least one bearing.

5. The musical instrument lever of claim 3, which further includes at least one dovetail clamp which is operably connected to said brace tube and to said slide bracket base, and which is sized to at least partially encircle said brace tube.

6. The musical instrument lever of claim 1, wherein said fulcrum further includes at least one spring.

7. The musical instrument lever of claim 6, wherein said at least one spring is a helical spring.

8. The musical instrument lever of claim 1, wherein said at least one connector is a socket head cap screw.

9. The musical instrument lever of claim 1, wherein said pivot mechanism is operatively connected to said valve by a stop arm.

10. The musical instrument lever of claim 9, wherein said stop arm is operatively attached to a valve shaft of said valve.

11. The musical instrument lever of claim 10, wherein said valve is a rotary valve.

12. The musical instrument lever of claim 10, wherein said valve shaft protrudes through a back plate of said valve.

* * * * *